US007109939B2

(12) United States Patent
Lynch et al.

(10) Patent No.: US 7,109,939 B2
(45) Date of Patent: Sep. 19, 2006

(54) WIDEBAND ANTENNA ARRAY

(75) Inventors: Jonathan J. Lynch, Oxnard, CA (US); Joseph S. Colburn, Los Angeles, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 10/407,057

(22) Filed: Apr. 3, 2003

(65) Prior Publication Data

US 2003/0214450 A1 Nov. 20, 2003

Related U.S. Application Data

(60) Provisional application No. 60/378,151, filed on May 14, 2002.

(51) Int. Cl.
*H01Q 13/10* (2006.01)

(52) U.S. Cl. ..... 343/771

(58) Field of Classification Search ..... 343/771, 343/772, 776, 789, 770, 725, 767, 705
See application file for complete search history.

(56) References Cited

U.S. PATENT DOCUMENTS

| | | | | |
|---|---|---|---|---|
| 4,684,952 | A | 8/1987 | Munson et al. | 343/700 MS |
| 5,086,340 | A * | 2/1992 | Citta et al. | 348/21 |
| 5,459,474 | A * | 10/1995 | Mattioli et al. | 343/702 |
| 5,461,392 | A * | 10/1995 | Mott et al. | 343/725 |
| 5,481,385 | A | 1/1996 | Zimmerman et al. | 359/40 |
| 5,557,291 | A | 9/1996 | Chu et al. | 343/725 |
| 6,208,308 | B1 | 3/2001 | Lemons | 343/785 |
| 6,219,000 | B1 * | 4/2001 | McWhirter et al. | 343/767 |
| 6,535,169 | B1 * | 3/2003 | Fourdeux et al. | 343/700 MS |
| 6,600,453 | B1 * | 7/2003 | Hadden et al. | 343/770 |
| 6,621,463 | B1 * | 9/2003 | Lam | 343/792.5 |
| 6,624,787 | B1 * | 9/2003 | Puzella et al. | 343/700 MS |
| 6,653,985 | B1 * | 11/2003 | Sikina et al. | 343/853 |
| 6,850,204 | B1 * | 2/2005 | Angelucci | 343/770 |
| 2003/0122724 | A1 * | 7/2003 | Shelley et al. | 343/786 |
| 2004/0080463 | A1 * | 4/2004 | Jeong | 343/770 |

FOREIGN PATENT DOCUMENTS

| | | |
|---|---|---|
| EP | 0 665 607 A1 | 8/1995 |
| WO | 95/23440 | 8/1995 |

OTHER PUBLICATIONS

Mailloux, R.J., "Antenna Array Architecture," *Proceedings of the IEEE*, vol. 80, No. 1, pp. 163-172 (Jan. 1992).
Shively, D.G., et al., "Wideband Arrays with Variable Element Sizes," *IEE Proceedings*, vol. 137, Pt. H, No. 4, pp. 238-240 (Aug. 1990).

* cited by examiner

*Primary Examiner*—Hoang V. Nguyen
*Assistant Examiner*—Huedun X. Cao
(74) *Attorney, Agent, or Firm*—Ladas & Parry LLP

(57) ABSTRACT

An antenna array comprises a substrate; a plurality of projecting, tapering structures disposed in an array and attached to a first major surface of said substrate, the plurality of projecting, tapering structures defining a plurality of waveguides therebetween; and a plurality of box-shaped structures disposed in an array and attached to a second major surface of the substrate, the plurality of box-shaped structures defining a plurality of waveguides therebetween, the plurality of waveguides defined by the plurality of projecting, tapering structures aligning with the plurality of waveguides defined by the plurality of box-shaped structures. The substrate includes a plurality of probes for feeding the plurality waveguides.

40 Claims, 11 Drawing Sheets

WIDEBAND ANTENNA ARRAY

This application claims benefit of U.S. Ser. No. 60/378,151, filed on May 14, 2002.

TECHNICAL FIELD

This invention relates to a novel method of achieving wideband electronically scanned antenna performance over a wide field of view with a structure that is very easy to fabricate and integrate with both standard microwave printed circuits and electronics. In particular, it relates to a wide bandwidth co-planar waveguide (CPW) to freespace transition constructed by attaching simple elongated radiating elements directly to printed circuit boards (PCBs).

This invention has both commercial and military applications. On the commercial side, this invention will allow a low cost electronically scanned antenna (ESA) to be available for terrestrial terminals in direct broadcast satellite and commercial marine applications. On the military side, this invention is applicable to battlefield communications via satellite, as well as advanced antenna concepts such as a distributed digital beamforming array.

BACKGROUND OF THE INVENTION

Many existing antenna arrays utilize printed circuit board (PCB) antennas as the radiating elements. Patch antennas are often formed on PCBs using standard PCB fabrication techniques. Although PCB technology provides a potentially low-cost fabrication method, prior art arrays of patch antennas are inherently narrowband due to the narrowband nature of the radiating elements, i.e., the patches. Some researchers have attempted to increase the bandwidth of PCB array antennas by utilizing wideband printed circuit elements such as printed spiral antennas. Although these elements are inherently wideband, they require a large area (relative to a wavelength of the frequencies of interest) and the element spacing cannot be made small enough to avoid grating lobes for scans at low elevation angles. Thus, these prior art wideband elements severely limit the achievable field of view of the array.

Elongated radiating elements are known in the prior art as seen with the dielectric rod antenna disclosed in U.S. Pat. No. 6,208,308. Although this antenna is wideband and can be closely spaced to neighboring elements, the dielectric rod is not inherently compatible with PCB technology. The most common way to excite a rod antenna is from a waveguide. Since a typical low cost array requires that electronic components be mounted on a PCB, this type of array requires a PCB to be mounted to a dielectric rod transition. A low cost method of fabrication for this complicated transition structure does not exist at this time. (Note: many practical antenna arrays require thousands of elements.)

One related prior art disclosure is the microstrip reflect array antenna described in U.S. Pat. No. 4,684,952. This antenna suffers the limitations described above, specifically that the bandwidth is very low, a few percent at most. The present invention provides better impedance and pattern bandwidth by using radiating elements that are not constrained to be planar. In one embodiment, the radiating elements are pyramidal in shape although other shapes could be used that may give even better performance. The extent of the radiating element, which may be more than one wavelength, creates a gradual transition from the narrow throat of the element (near the planar element feed) to free space, thus obtaining a relatively good impedance match over a wide frequency range.

Other antenna arrays attempt to increase the bandwidth by various means. One approach uses "wideband" patch elements that contain parasitic patches or stubs. Although this does increase the array bandwidth somewhat, patches remain inherently narrowband and the overall array bandwidth remains low. Another approach, found in D. G. Shively and W. L. Stutzman, "Wideband arrays with variable element sizes," IEE Proceedings, Vol. 137, Pt. H, No. 4, August 1990, suggests the use of other wideband printed elements for use in an array, such as printed spirals. Wideband planar antennas necessarily have a width that is larger than half a wavelength, usually by many wavelengths. Incorporating any planar wideband element into an array restricts how close the elements can be placed. This restriction limits the amount of scanning that can be accomplished (i.e., the antenna field of view) since excessive scanning will result in grating lobes unless the inter-element spacing can be kept near half a free space wavelength. The present invention extends the element size in a direction perpendicular to the plane of the array to achieve wideband characteristics while keeping its extent in the plane of the array to half a wavelength or less. This way, wideband operation can be achieved over a wide field of view.

Typical phased array antennas are made of transmit/receive (T/R) modules that contain the radiating element as well as RF electronics, such as low noise amplifiers, mixers, and oscillators. This modular architecture allows each individual element to be manufactured separately; however, high gain antenna arrays that require thousands of elements are extremely expensive. A more recent approach found in R. J. Mailoux, "Antenna Array Architecture," Proc. IEEE, vol. 80, no. 1, 1992, pp 163–172, has been the "tile" architecture where the RF circuitry for each element resides on a planar surface with the radiating element located on the backside of the planar RF substrate. The present invention preferably uses "tile" architecture, which is lower in cost than the T/R module approach, but the tiles must be electrically connected to the radiating element with low RF losses. To avoid complicated RF transitions, it is desirable to use radiating elements that are compatible with PCB technologies. This invention describes how to make very wide bandwidth radiating elements that are fully compatible with PCB technologies.

BRIEF DESCRIPTION OF THE INVENTION

In one aspect, this invention provides an antenna array (i.e., 2×2 or larger). This antenna array comprises a substrate; a plurality of substrate to freespace transitions disposed in an array and attached to a first major surface of said substrate, the plurality of substrate to freespace transitions defining a first plurality of waveguides therebetween; and a plurality of probes for feeding said first plurality of waveguides.

In another aspect, the invention provides a method for making a wideband antenna array comprising the steps of: providing a substrate; attaching a plurality of substrate to freespace transitions disposed in an array to a first major surface of the substrate, the plurality of substrate to freespace transitions defining a first plurality of waveguides therebetween; and placing a plurality of probes over said plurality of first waveguides.

In another aspect, this invention provides an array (i.e., 2×2 or larger) of substrate to freespace transitions that are attached to a printed circuit board (PCB). This structure can be manufactured in a straightforward manner by placing thin sheets of conductive adhesive on a PCB, placing the radiating elements on the adhesive, and heating the structure until adhesion takes place. In this manner, many hundreds or thousand of elements can be attached simultaneously. The PCB preferably includes a top side metal pattern that connects to the radiating elements, and a bottom side metal pattern that consists of CPW circuitry and surface mounted active components. The top and bottom metal patterns are connected by plated through holes (vias).

This invention significantly extends the frequency range over which an antenna array can be operated by utilizing radiating elements that are elongated. The preferred fabrication method efficiently connects the elements to a PCB. Furthermore, the close spacing of the array elements allows the array to scan down to low elevation angles without producing grating lobes and the packing of the array elements enables dual polarization operation.

DETAILED DESCRIPTION

Figure 1:
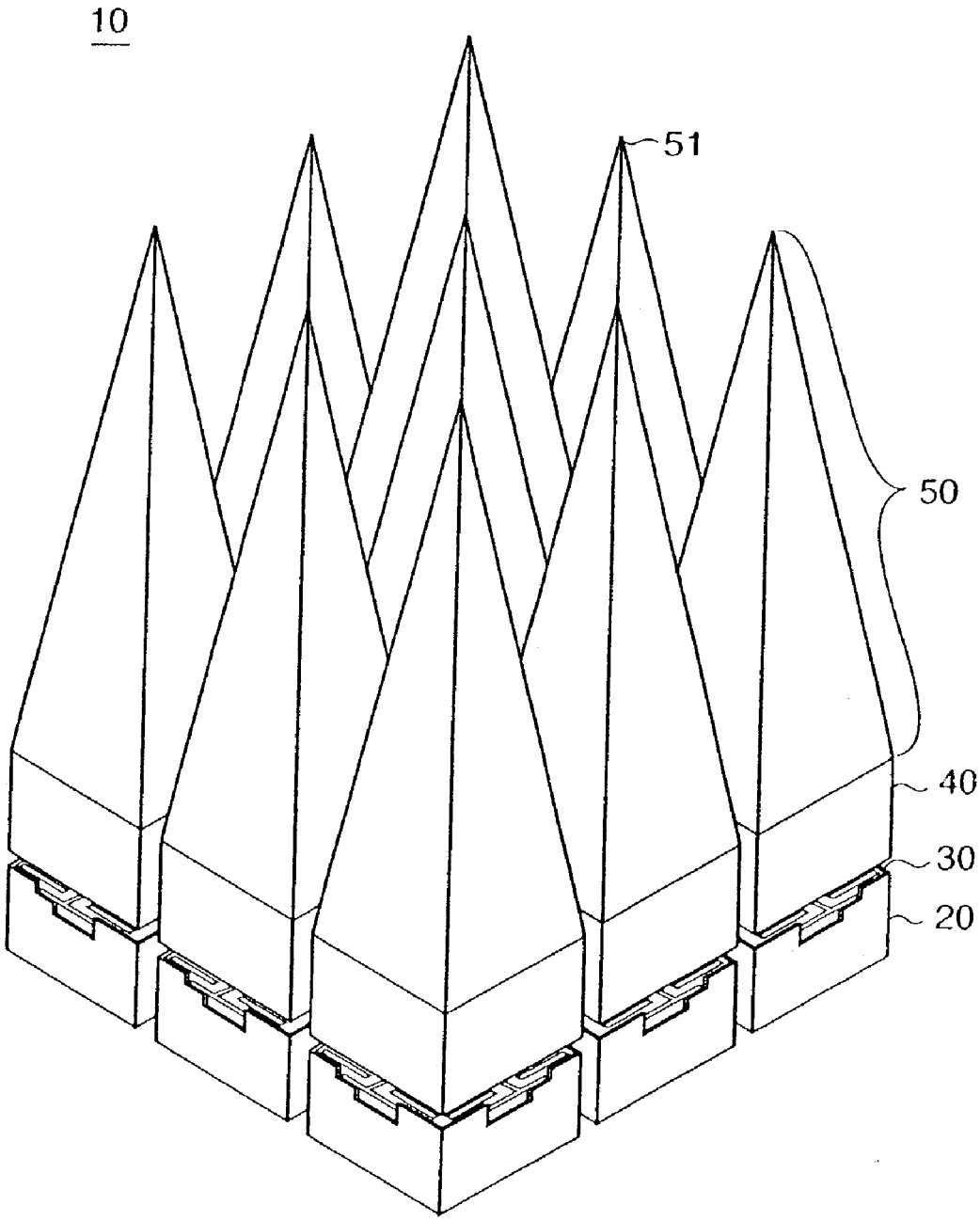
FIG. 1 is a schematic, perspective view of a 3×3 array of the co-planar waveguide (CPW) to freespace transition structure.

FIG. 1 is a schematic of a 3×3 array of the co-planar waveguide (CPW) to freespace transition structure 10. The basic array element is a simple CPW fed parallel plate waveguide structure with a gradual, tapered transition to freespace. The structure 10 can be broken down into four different sections: an optional lower parallel plate waveguide section 20; a circuit board layer that contains the CPW probe and active electronics 30; an upper parallel plate waveguide section 40; and a substrate to freespace transition 50. FIGS. 2 through 5 detail each of the three lower sections.

Figure 2A:
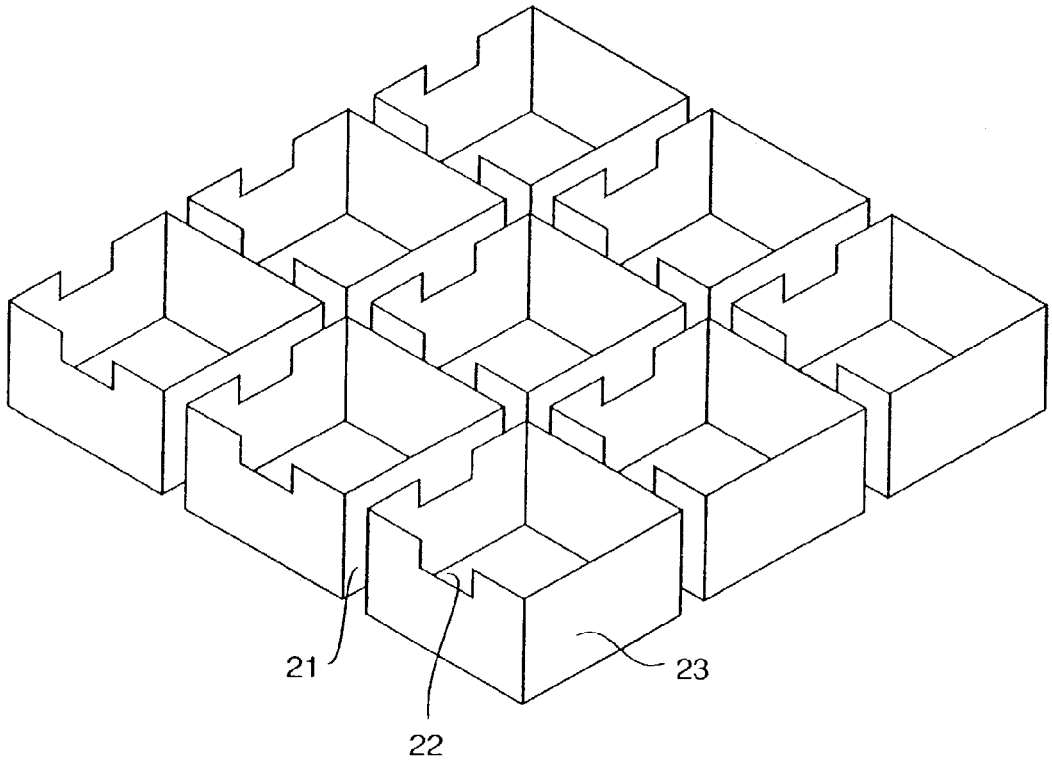
FIG. 2*a* is a schematic, perspective view of a first section of the structure shown in FIG. 1.

The optional portion 20 of the structure 10 is shown in FIG. 2*a*. The optional portion 20 defines a series of criss-crossed parallel plate waveguides 21 formed by walls 23 defining box-shaped structures. The box-shaped structure can take the shape of a square or a rectangle. At the top of one wall for each of these parallel plate waveguides 21 is a rectangular aperture or notch 22 to accommodate a CPW to parallel plate waveguide probe 31 (see FIG. 3*a*). These notches prevent the waveguide walls 23 from shorting to the CPW transmission lines 33 (see FIG. 3*b*) discussed herein.

Figure 2B:
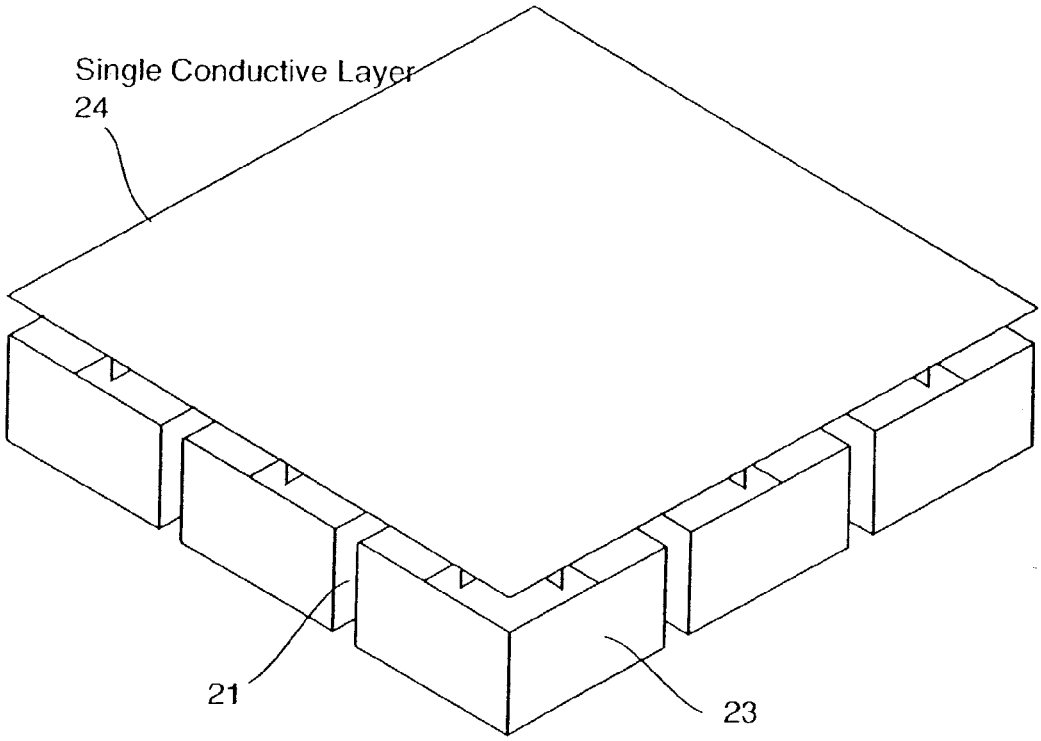
FIG. 2*b* is a depiction of a single conductive layer attached to the first section of the structure shown in FIG. 2*a;*
Figure 2C:
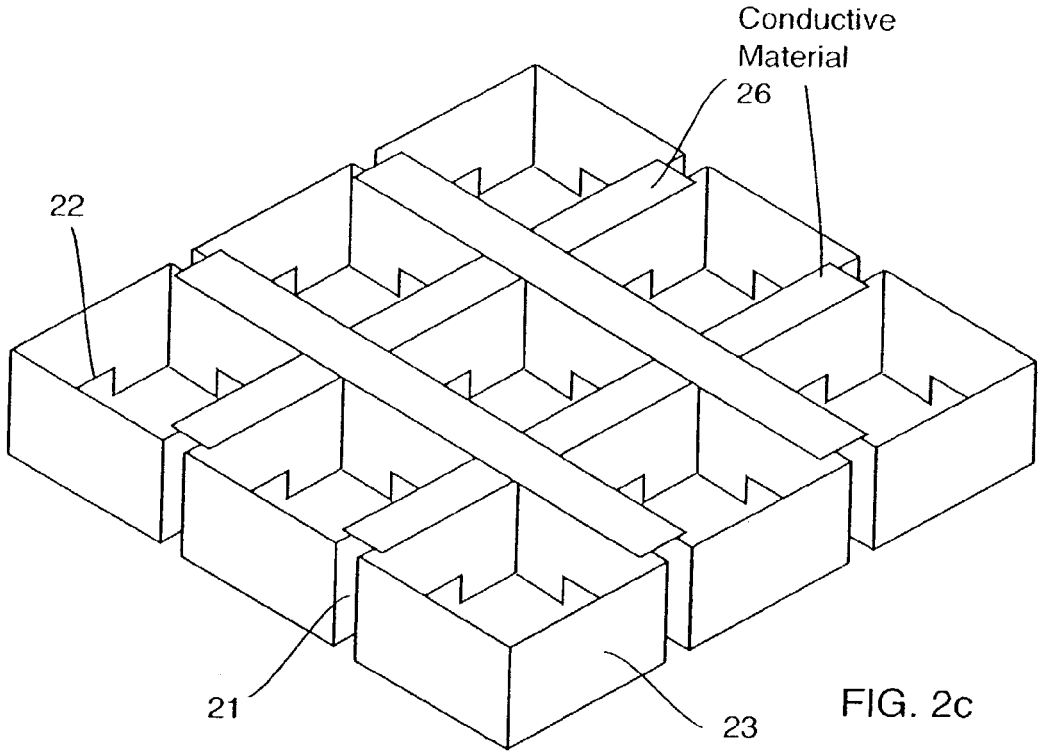
FIG. 2*c* is a depiction of a conductive layer attached only to the walls of the first section of the structure shown in FIG. 2*a;*

Each of the parallel plate waveguides 21 preferably has a short circuit termination. Other terminations, besides short circuits, could be used. For example, each of the parallel plate waveguides 21 could be terminated in a matched load to increase the bandwidth performance of the structure. However, a matched load termination would reduce the gain of the structure. There are at least two methods of providing a short circuit termination for each of the parallel plate waveguides 21. First, as shown in FIG. 2*b*, each wall 23 is attached to an adjacent wall 23 by means of a conductive sheet 24 at the bottom. This conductive sheet 24 may cover the entire bottom area of structure 20 to help ensure that there is no significant backwards directed radiation. A second method for providing the short circuit termination, as shown in FIG. 2*c*, is for a conductive material 26 to cover at least the bottom of the parallel plate waveguides 21 to allow for access to the printed circuit board layer.

The thickness of the walls 23 is not critical to the design; however, the distance between the conductive layer 24 or 26 and the notch 22 for CPW to parallel plate waveguide is important. The section of waveguide 21 below the CPW to parallel plate waveguide probe 31, which is defined by distance from the conductive layer 24 or 26 and the notch 22 for CPW to parallel plate waveguide probe 31, provides some reactance at the interface of the probe 31 and parallel plate waveguide 21. This reactance can be used to improve, or in other words match, the transfer of energy from the CPW lines 33 to the parallel plate waveguide 21 and vice versa. The length of this section, a degree of freedom, can be changed to get the best match or energy transfer.

There are a variety of methods that can be used to fabricate the first portion 20. The walls 23 and the conductive layer 24 or 26 may be fabricated as separate pieces or as one piece. The individual pieces or the entire structure 20 may be machined from metal if the number of pieces to be made is not large. For larger production runs, the structures 20 or individual pieces are preferably made using injection molding techniques. These techniques may include the injection molding of a metal, or the injection molding of a plastic that would then be plated with a conductive material such as copper or aluminum.

Figure 3A:
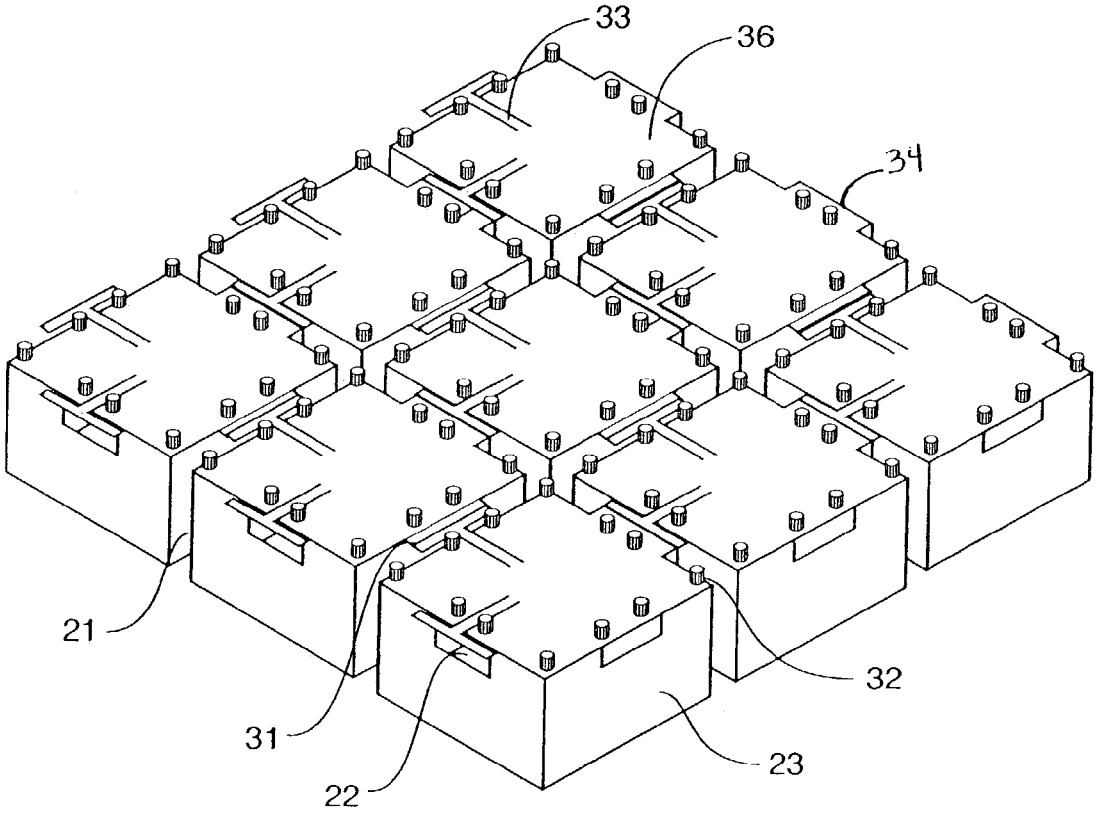
FIG. 3*a* is a schematic, perspective view of a third section of the structure shown in FIG. 1, the third section including a PCB with the CPW probes that feed the parallel plate waveguides.
Figure 3C:
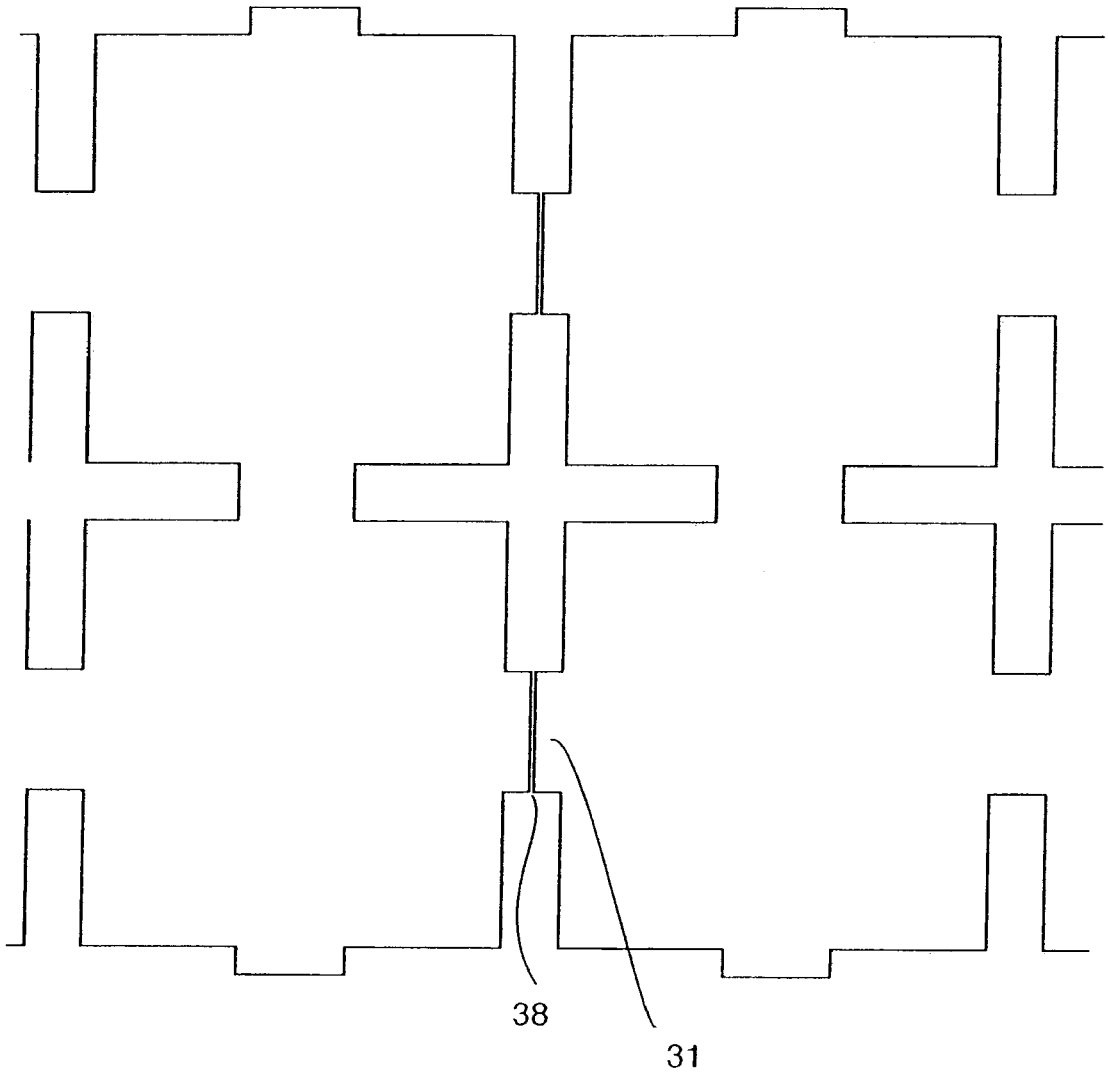
FIG. 3*c* is a depiction of where to join two antenna subarrays.
Figure 3D:
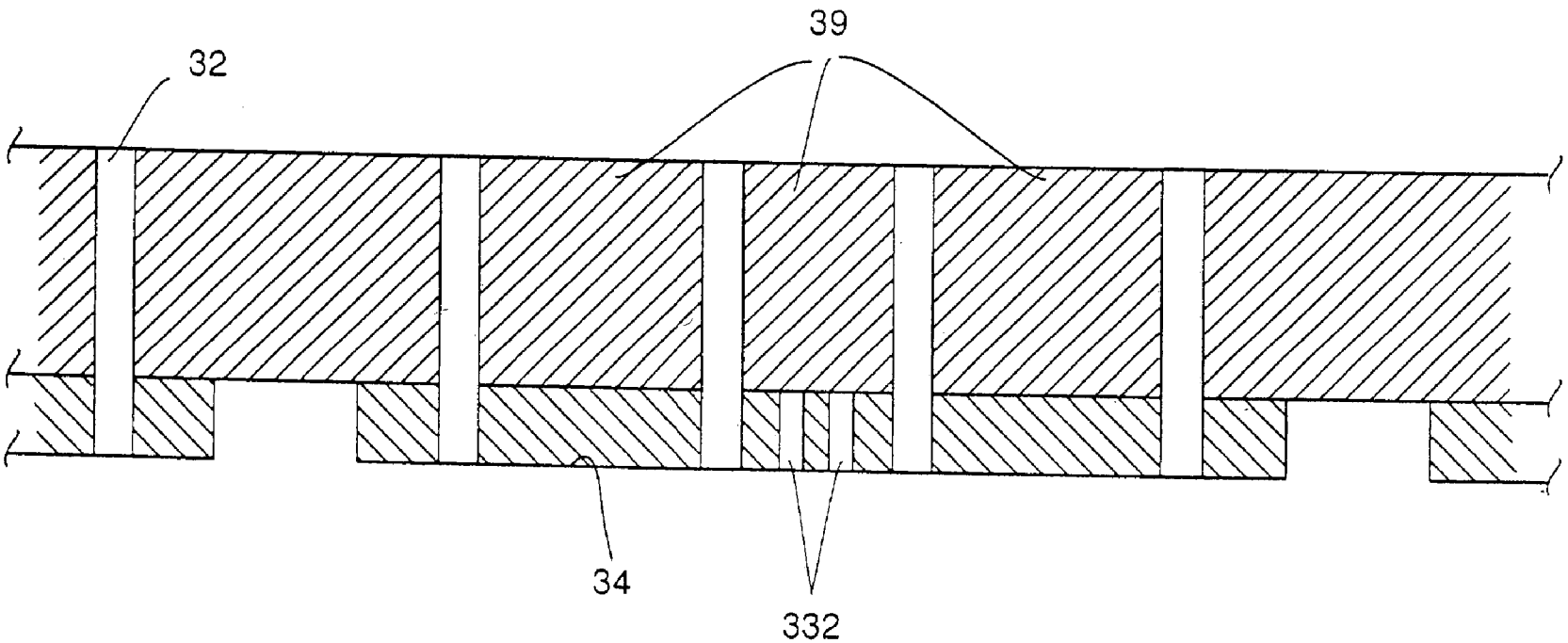
FIG. 3*d* is a cross-sectional view of FIG. 3*b;*
Figure 4:
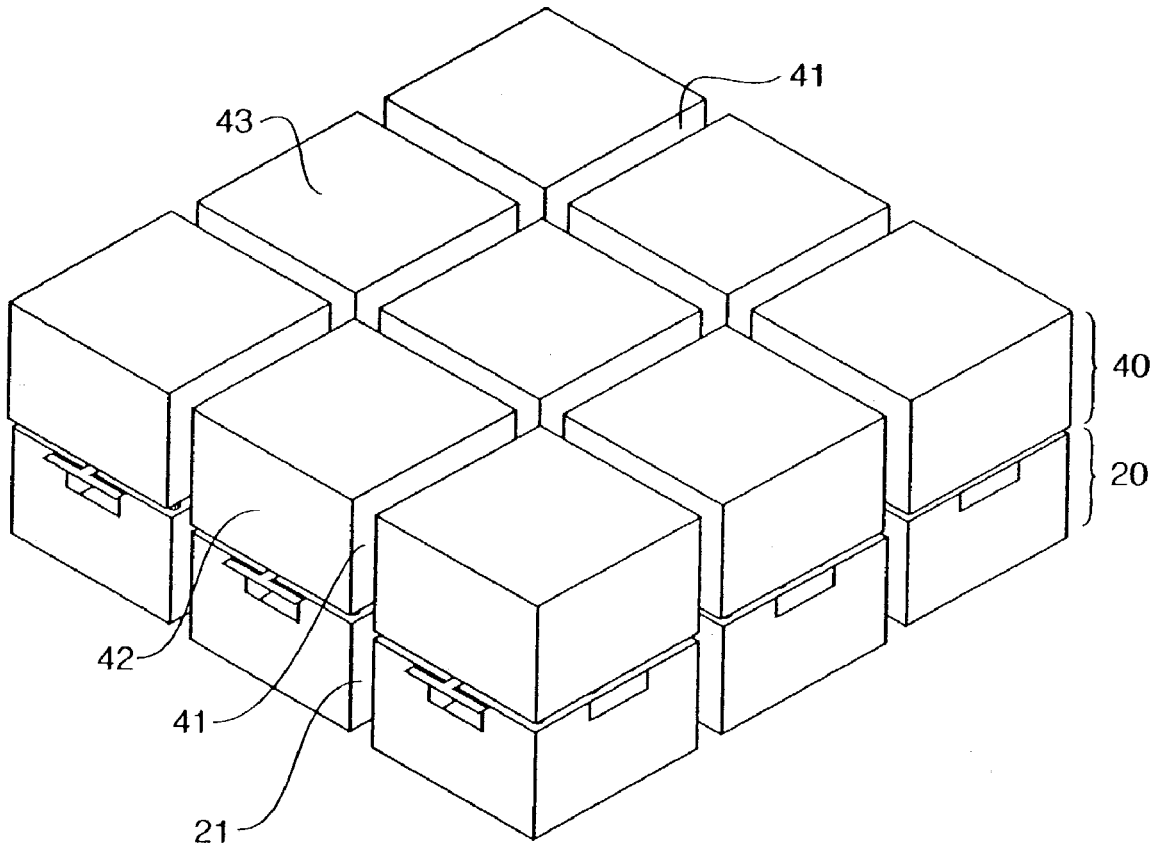
FIG. 4 is a schematic, perspective view of an upper parallel plate waveguide crisscross section of the structure shown in FIG. 1.

The second portion 30 of the structure 10 consists of a PCB with CPW probes 31 that feed the parallel plate waveguides 21 (see FIG. 3*c*) and/or the parallel plate waveguides 41 (see FIG. 4). In FIG. 3*a* only the metal layer 34, containing the CPW transmission lines 33 and the ground plane 36, is shown disposed over the optional waveguide structure 20. Other microwave elements, such as filters and matching stubs, may also be contained in the metal layer 34.

Figure 3B:
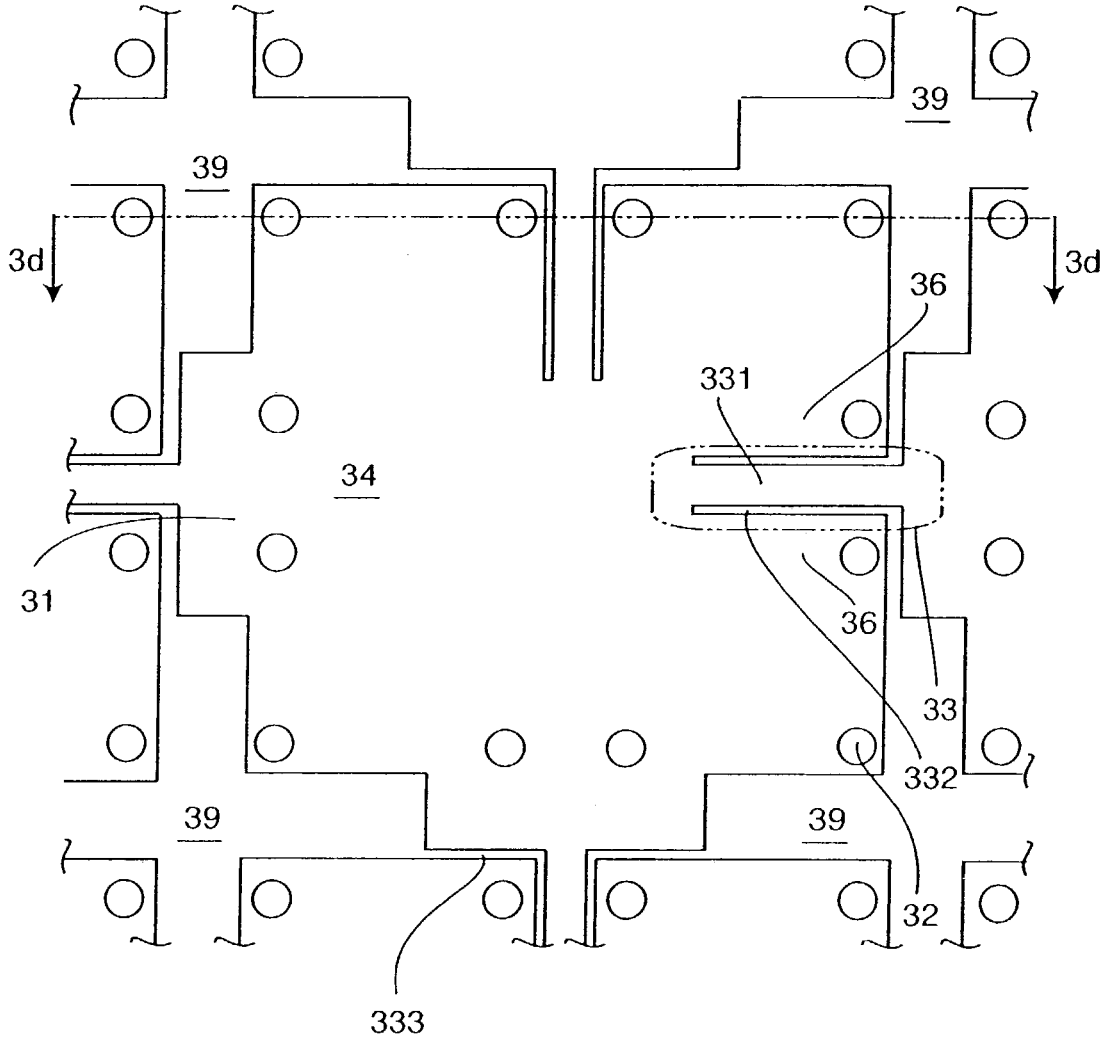
FIG. 3*b* is a detailed view of the CPW to parallel plate waveguide probes and the CPW transmission lines.

As shown in FIG. 3*b*, the CPW transmission lines 33 consist of three conductors located in a plane. The center conductor 331, which is relatively narrow is excited relative to the two ground planes 36, which are relatively wide that exist on either side of the center conductor 331 with a small carefully controlled separation 332 between them.

As shown in FIG. 3*b*, all the CPW transmission lines 33 are terminated in a short, that is the center conductors 331 are connected to the ground planes 36; however, these CPW transmission lines 33 may also be connected to other active elements such as amplifiers and phase shifters. The substrate layer 39 upon which the metal layer 34 is disposed (omitted in FIG. 3*a* for the sake of clarity) is positioned such that the metal layer 34 is disposed on the bottom side thereof (see FIG. 3*d*), and this metal side or layer 34 is located adjacent to the waveguides 21 as depicted by FIG. 3*a*. The metal layer 34, containing the CPW transmission lines 33 and ground planes 36, is in direct electrical contact with the parallel plate waveguide walls 23. The CPW transmission lines 33 and parallel plate waveguide probes 31 extend over the parallel plate waveguides 21. Note the entire region between the parallel plate waveguides 21 is empty, leaving room for surface mounted active electronics and printed microwave circuits components. Vias 32 through the substrate provide a ground plane connection to upper parallel plate waveguide walls 42 as shown in FIG. 4.

The upper parallel plate waveguide crisscross portion 40, shown in FIG. 4, is formed by placing an array of metallic boxes 43 on top of the PCB layer which form walls 42 of an upper parallel plate waveguides 41. As with the lower box-shaped structures, the walls 42 of the metallic boxes 43 can take the shape of a square or a rectangle. For example, the metallic boxes 43 may be formed by machining solid metal, if small numbers are needed or by injection molding, if large numbers are needed. Injection molding can be used to form the metallic boxes out of metal or out of plastic with a conductive coating such as copper or aluminum. The vias 32 through the microwave substrate 39 provide electrical contact between the CPW ground planes 36 and the walls 42 of the upper parallel plate waveguides 41.

The box/pyramidal elements 43, 51 are in electrical contact with the walls of the lower waveguide structure 23. The walls of the lower waveguide structure 23 are electrically connected to the CPW ground planes 36. The CPW ground planes are electrically connected to the top box/pyramidal elements 43, 51 through vias 32 in the microwave substrate.

Figure 5A:
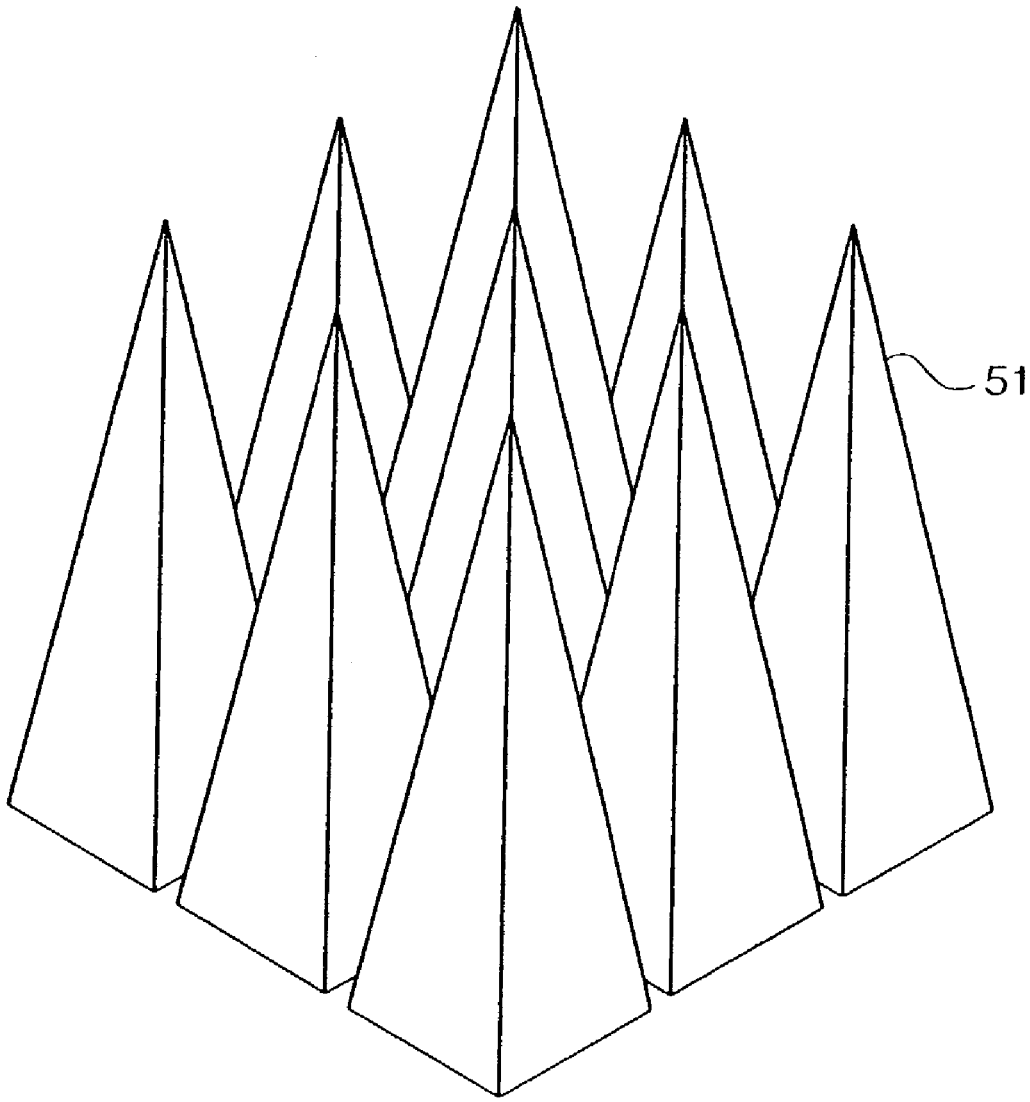
FIG. 5*a* is a schematic, perspective view of one embodiment of the last section of the structure shown in FIG. 1, the last section providing a smooth transition from the parallel plate waveguides to freespace.
Figure 5B:
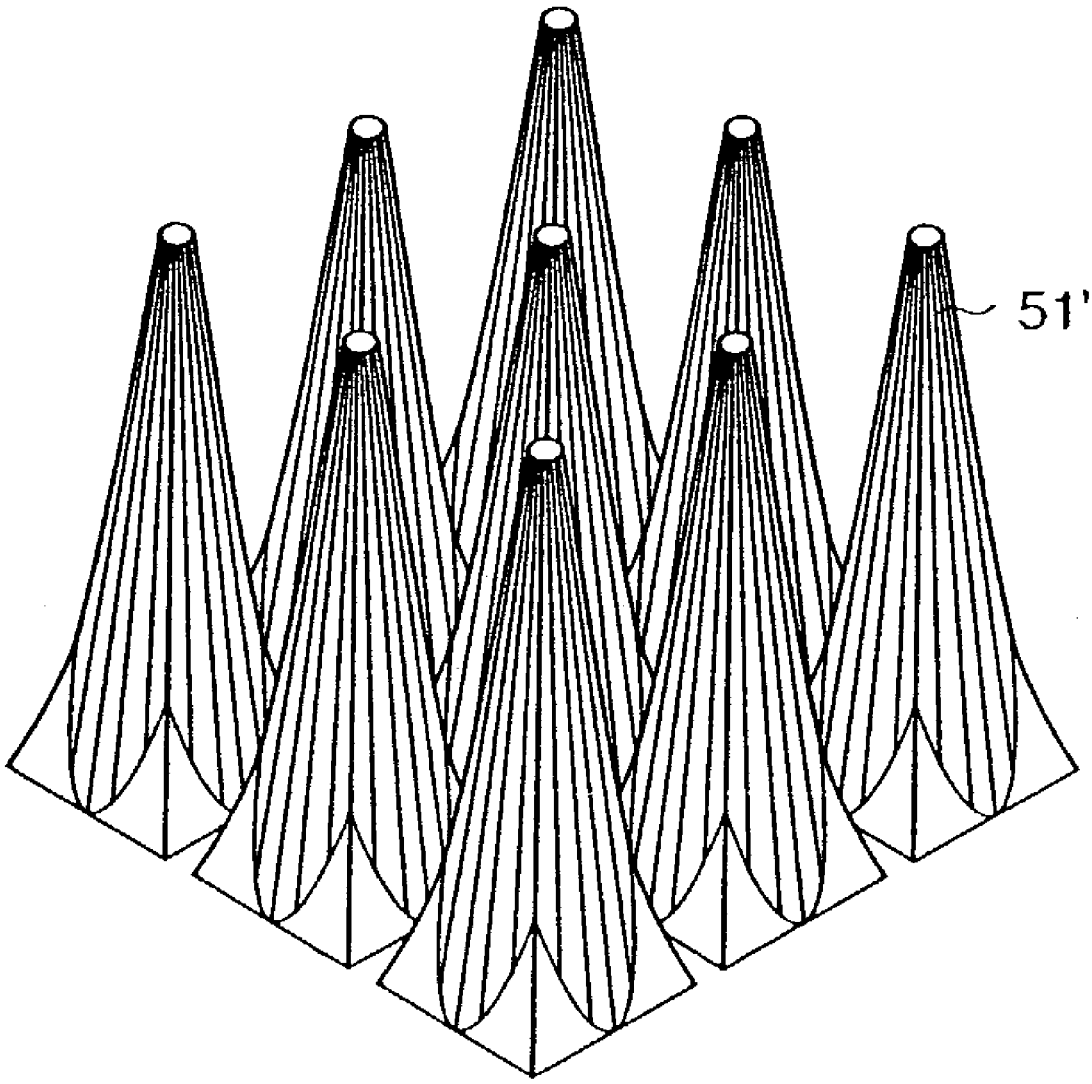
FIG. 5*b* is a schematic, perspective view of another embodiment of the last section of the structure shown in FIG. 1, the last section providing a smooth transition from the parallel plate waveguides to freespace.

The final portion 50 provides a smooth transition from the crisscross of parallel plate waveguides 40 to freespace. This section 50 is formed by arranging an array of projecting, tapering structures 51, as shown in FIG. 5*a*. In the preferred embodiment the structures take the form of metallic pyramids 51, but other projecting, tapering structures such as conical shape structures 51' (as shown in FIG. 5*b*), may be used on top of the array of boxes 43 forming the upper parallel plate waveguide section 40. The array of pyramids 51 or conical shaped structures 51' are preferably made using plastic injection molding with a conductive layer as described above. Each box 43 and its associate pyramid 51 (or conical shaped structure 51') are preferably made as an integral unit 43, 51 referred to as substrate to freespace transition. Thus, the upper waveguide section (metallic boxes 43) and parallel plate waveguide to freespace transition (the metallic pyramids 51) layers are preferably fabricated as a single structure; they are denoted as separate structures herein for ease of disclosure. These simple structures 43, 51 are spaced from each one another to provide for the parallel plate waveguide 41. When the upper waveguide section (metallic boxes 43) and the waveguide to freespace transition (the metallic pyramids 51) are fabricated as a single structure they may be joined by any of the well-known methods available to one skilled in the art. For example, one may choose to solder the upper waveguide section to the waveguide to freespace transitions using a solder preform.

This entire structure can be united in a straightforward manner. For example, the optional lower waveguide structure 20 can be placed below the PCB while the metallic box/pyramidal elements 43, 51 are placed on top of the PCB with solder preforms between the layers. By heating the structure to flow the solder, the lower waveguide structure 20 and the box/pyramidal elements 43, 51 are joined to the PCB. Alternatively, the metallic box/pyramidal elements 43, 51 can be joined to the topside of the PCB and the walled structures 23 of the lower waveguide structure 20 can be joined to bottom side of the PCB using a suitable conductive adhesive. Either way, very large numbers of box/pyramidal elements 43, 51 and very large numbers of walled structures 23 can be attached to the circuit board simultaneously. The wide bandwidth characteristic of this structure makes it insensitive to alignment errors between the layers. Thus, it could be fabricated very inexpensively using high volume production techniques. Typical tolerances for the lower waveguide 21 to upper waveguide 41 alignment is 5 mils (0.13 mm).

Depending on the size of the antenna array, the PCB or substrate can be fabricated as a single piece (as shown in FIG. 3*a*) or it can be fabricated as more than one piece (as shown in FIG. 3*c*). Fabricating the PCB as more than a single piece is useful in applications with thousands of elements. When the PCB is fabricated as more than a single piece, the probes 31 are preferably soldered together 38 to provide a continuous electrical connection across the waveguide 21.

Depending on the size of the antenna array, the preferred embodiment has substrate 39 as one continuous piece or several large continuous pieces for large antenna arrays. The metal layer 34 disposed on substrate 39 is etched to provide the pattern shown in FIGS. 3*a* and 3*b*. However, one skilled in the art will appreciate that any area where the metal layer has been etched, the substrate could also be removed.

One technique of building a large antenna array is to build several smaller array structures as described above and shown in FIG. 1. Once the smaller array structures are completed, they are attached in two places. First, the probes 31 on adjacent array structures are preferably connected to provide a continuous electrical connection across the waveguide 21. Second, the conductive layer 24 or 26 of the adjacent antenna array structures are preferably connected to provide a continuous potential for the short circuit termination of the waveguides 21. The spacing between the adjacent antenna array structures is preferably the same as the spacing between the individual elements within one of the antenna array structures.

There are many degrees of freedom in the CPW to freespace transition described above to optimize the structure for particular applications. These degrees of freedom include: the height of the parallel plate waveguide 21, 41 and substrate to freespace transition sections 51; the dimensions of the CPW probe 31 and notches 22 in the lower parallel plate waveguide walls 23; and the impedance of the CPW lines 33. Also, one skilled in the art could by experimentation or computer simulation vary any and all of these dimensions to achieve the desired bandwidth and scan range.

One skilled in the art will appreciate that because the height of the parallel plate waveguide 21 is a degree of freedom in the design, the height of the parallel plate waveguides 21 may also be zero. In other words, the antenna array may be built without structure 20. The height of the parallel plate waveguides 21 provides a degree of design freedom to provide a better match over a wider frequency range for the CPW probe to parallel plate waveguide transition. In some cases, one may choose the limitation of not having this degree of design freedom in order to reduce the overall array thickness and fabrication complexity.

In addition, the PCB substrate can be flipped over, placing the metal layer 34 on top. In order to accommodate this modification to the design, the notches 22 in the lower parallel plate waveguide walls 23 would no longer be needed. Instead, notches in the upper parallel plate waveguide walls 42 would be required to prevent the CPW transmission lines 33 from shorting to the upper waveguide walls 42 and the metallic boxes/pyramids 43, 51 would be made hollow to prevent the CPW lines 33 from shorting to the boxes/pyramids 43, 51.

In FIGS. 1 through 5 the depicted structure 10 is formed from a 3×3 array of basic elements. This array is too small, in terms of the number of elements utilized, for most applications. It is depicted as a simple 3×3 array merely for ease of illustration. In use, the actual embodiments will likely include thousands of such basic elements (e.g., thousands of pyramids 51, pyramid bases walled structures 23), depending on the needs of a particular application for the wideband antenna array 10.

Figure 6:
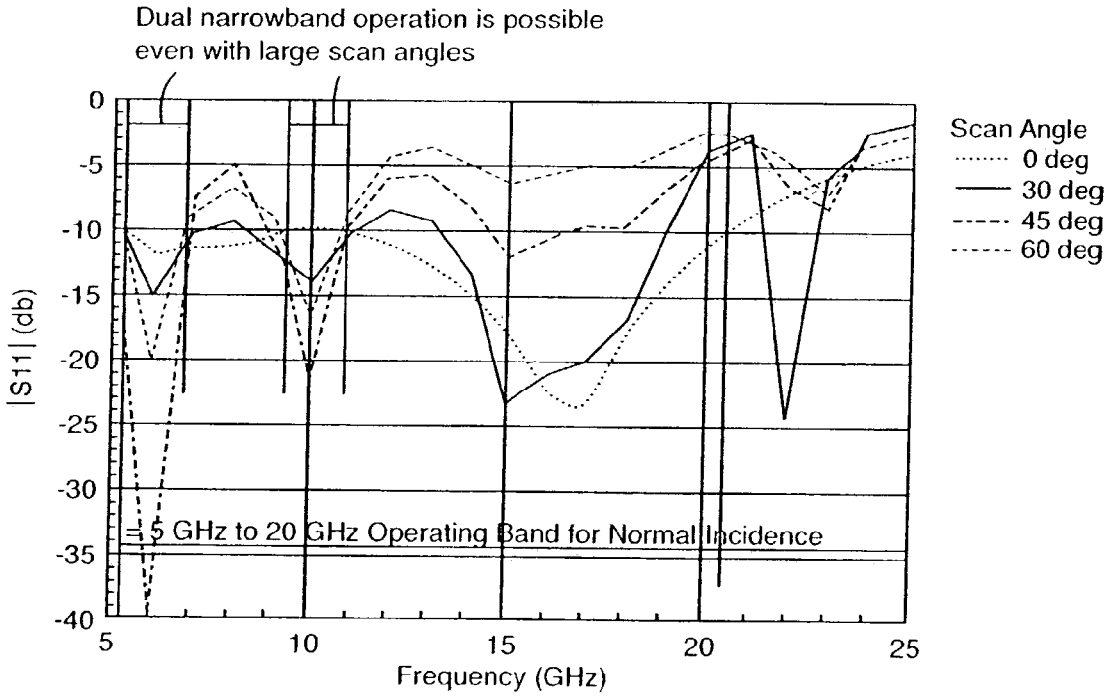
FIG. 6 is a graph of the computed input match of the CPW feed under various scan angles for one particular embodiment of the disclosed wideband antenna array.

This antenna structure disclosed herein has not yet been fabricated and tested, but full wave electromagnetic computer simulations have been run and the results are depicted in FIG. 6. The simulation tool used was Ansoft's HFSS, which is a finite element electromagnetic field solver. With this software, it is possible to simulate the performance of a radiator in an array environment using periodic boundary conditions. By applying a phase progression between parallel walls in the periodic cell, it is also possible to model the array element under beam scanning conditions.

FIG. 6 contains plots of the computed input impedance match (|S11|) of the CPW to freespace transition structure 10 described herein for a particular embodiment or size, which is described below as a function of frequency under different array beam scanning conditions. A zero degree scan denotes an array beam pointing perpendicular to the surface of the array and a 60 degree scan indicates an array beam pointing 60 degrees from the perpendicular of the array surface.

From the computed input impedance plot shown in FIG. 6, one can see that for the case of normal incidence the CPW to freespace transition structure 10 has approximately a 120 percent bandwidth. Bandwidth is defined as the frequency range for which the reflection coefficient, or |S11|, is less than or equal to −10 dB. For a normal incidence or 0 degree scan angle, the frequency band for which this holds is from 5 GHz to 20 GHz, or the percentage bandwidth $\{[20-5]/[(20+5)/2]\}*100=120\%$. Even for a 45-degree beam scan, the transition has approximately 25% bandwidth. For a larger scan angle, the structure does not exhibit a wide operational bandwidth, although it does exhibit dual narrow band operation. From 5 GHz to 7 GHz and from 9 GHz to 11 GHz the reflection coefficient is below −10 dB for 0, 30, 45 and 60-degree scan angles. Thus, in these relatively narrow frequency bands the antenna could be used for any of these scan angles. Therefore, the dual narrowband characteristic under large scan conditions can be observed in the narrowband matches centered around 6 and 10 GHz.

One skilled in the art will appreciate the tradeoff between bandwidth and scan angle in determining the geometry of the wideband antenna array 10. In order to obtain the widest field of view (largest scan angle), the spacing between elements is preferably half a freespace wavelength. However, the widest field of view comes at an expense of bandwidth. If no scanning is desired, then the longer the length of the radiating elements, the greater the bandwidth of the wideband antenna array. However, for the same length of radiating elements the scan performance degrades. Making the radiating elements shorter improves the scan performance, but reduces the bandwidth. Thus, the dimensions of the present invention will be determined based upon the application.

The simulation results shown in FIG. 6 are for one particular sized geometry of the wideband antenna array 10. However, wideband antenna array 10 is easily scaleable to other frequency ranges. The simulated wideband antenna array 10 simulated has a periodic cell size 23, 43 of 0.315×0.315 inches (8×8 mm), the height of the pyramids 51 is 0.984 inches (25 mm), the height of the upper parallel plate waveguide section 42 is 0.177 inches (4.5 mm), the thickness of the circuit board is 0.02 inches (0.5 mm), and the height of the lower waveguide 21 is 0.157 inches (4 mm). The metal layer 34, 35, disposed on the substrate is copper at a thickness of 2 mils (0.05 mm). The separation 332 between the center conductor 331 and the ground plane 36 is 0.004 inches (0.1 mm). The width of the center conductor 331 is 0.008 inches (0.2 mm). The length of the probe 31 is 0.032 inches (0.8 mm). The spacing 333 between the probe 31 and the ground plane 36 is 0.008 inches (0.2 mm). For this size of a wideband antenna array 10, for normal incidence, the first grating lobe will not exist until 37.5 GHz and for a 60-degree scan, the first grating lobe will not exist below 20.1 GHz. The frequency at which the grating lobe will exist can be determined using the formula, $\text{frequency}=c/[d*(1+\sin\theta)]$, where c is the speed of light, d is the periodic cell size and θ is the scan angle.

In a reflect array arrangement, the length of each of the CPW lines 33 between the CPW to waveguide probe 31 and the terminating short circuit 36 varies as a function of the position in the array. By varying the length of each of the transmission lines 33 any prescribed phase shift can be generated.

Having described the invention in connection with the preferred embodiment thereof, modification will now certainly suggest itself to those skilled in the art. As such, the invention is not to be limited to the disclosed embodiments, except as required by the appended claims.

What is claimed is:

1. An antenna array comprising:

a substrate;

a plurality of substrate to freespace transitions disposed in an array and attached to a first major surface of said substrate, the plurality of substrate to freespace transitions defining a first plurality of parallel plate waveguides therebetween; and a plurality of probes parallel to said substrate for feeding said first plurality of waveguides.

2. The antenna array of claim 1, wherein said substrate comprises:

a ground plane disposed on said substrate;

at least one co-planer waveguide (CPW) transmission line disposed on said substrate, where said CPW transmission line is for connecting said ground plane to one of said plurality of probes; and at least one via for connecting said ground plane to said plurality of substrate to freespace transitions.

3. The antenna array of claim 1, wherein the parallel plate waveguides are perpendicular to said substrate.

4. The antenna array of claim 1, wherein the substrate is a microwave substrate.

5. An antenna array comprising:

a substrate;

a plurality of substrate to freesp ace transitions disposed in an array and attached to a first major surface of said substrate, the plurality of substrate to freespace transitions defining a first plurality of waveguides therebetween; and a plurality of probes for feeding said first plurality of waveguides, wherein said substrate to freespace transitions comprise projecting, tapering structures.

6. The antenna array of claim 5, wherein each projecting, tapering structure includes a first portion defining a box-shaped structure and an adjacent second portion defining a conical-shaped structure having a wide end and a narrow end, the wide end of the conical-shaped structure mating with the box-shaped structure.

7. The antenna array of claim 5, wherein each projecting, tapering structure includes a first portion defining a box-shaped structure and an adjacent second portion defining a quadrilateral having four sloping sides, the four sloping sides of the quadrilateral mating with four sides of the box-shaped structure.

8. The antenna array of claim 7, wherein the size of each sloping side of each projecting, tapering structure in said plurality of projecting, tapering structures is essentially the same size.

9. The antenna array of claim 5, wherein each projecting, tapering structure is solid metal.

10. The antenna array of claim 5, wherein each projecting, tapering structure comprises a plastic body covered by a layer of conductive material.

11. The antenna array of claim 1 further comprising a plurality of box-shaped structures disposed in an array and attached to a second major surface of said substrate, the plurality of box-shaped structures defining a second plurality of waveguides therebetween, wherein the second plurality of waveguides align with said first plurality of waveguides and said plurality of probes being for feeding said first and second plurality of waveguides.

12. The antenna array of claim 11, wherein each box-shaped structure in said plurality of box-shaped structures has four sides, said four sides defining a quadrilateral.

13. The antenna array of claim 12, wherein said quadrilateral is a square.

14. The antenna array of claim 11, wherein the plurality of box-shaped structures are metal.

15. The antenna array of claim 11, wherein each of the plurality of box-shaped structures comprises a plastic body covered by a layer of conductive material.

16. The antenna array of claim 11, wherein said substrate comprises:

a ground plane disposed on said substrate;

at least one co-planer waveguide (CPW) transmission line disposed on said substrate, where said CPW transmission line is for connecting said ground plane to one of said plurality of probes; and at least one via for connecting said ground plane to said plurality of substrate to freesp ace transitions.

17. The antenna array of claim 16, wherein at least one of said plurality of box-shaped structures contains a notch for preventing at least one CPW transmission line from shorting to at least one of said plurality of box-shaped structures.

18. The antenna array of claim 11, wherein said second plurality of waveguides defined by the plurality of box-shaped structures is terminated by a short-circuit.

19. The antenna array of claim 5, wherein the substrate is a microwave substrate.

20. A method for making a wideband antenna array, the method comprising the steps of:

providing a substrate;

attaching a plurality of substrate to freepace transitions disposed in an array to a first major surface of said substrate, the plurality of substrate to freespace transitions defining a first plurality of parallel plate waveguides therebetween; and placing a plurality of probes parallel to said substrate over said plurality of first waveguides.

21. The method of claim 20, wherein the step of providing a substrate comprises the steps of:

depositing a ground plane on said substrate;

etching said ground plane to provide at least one co-planer waveguide (CPW) transmission line; and creating at least one via through said substrate.

22. The method of claim 21 further comprising the step of attaching a plurality of box-shaped structures disposed in an array to a second major surface of said substrate, the plurality of box-shaped structures defining a second plurality of waveguides therebetween, the second plurality of waveguides being aligned with said first plurality of waveguides.

23. The method of claim 22, wherein the step of attaching a plurality of box-shaped structures comprises the step of preventing said CPW transmission line from shorting to said plurality of box-shaped structures by providing a notch in said plurality of box-shaped structures.

24. The method of claim 22, wherein the step of attaching a plurality of substrate to freespace transitions to a first major surface of said substrate, and the step of attaching a plurality of box-shaped structures disposed in an array to a second major surface of said substrate comprise the steps of:

placing a solder preform in contact with the plurality of substrate to freespace transitions and the first major surface of the substrate;

placing a solder preform in contact with the plurality of box-shaped structures disposed in an array and the second major surface of the substrate; and heating the plurality of substrate to freespace transitions, the substrate and the plurality of box-shaped structures to flow the solder.

25. The method of claim 22, wherein the step of attaching a plurality of substrate to freespace transitions to a first major surface of said substrate, and the step of attaching a plurality of box-shaped structures disposed in an array to a second major surface of said substrate comprise the steps of:

placing a conductive adhesive in contact with the plurality of substrate to freespace transitions and the first major surface of the substrate; and placing a conductive adhesive in contact with the plurality of box-shaped structures disposed in an array and the second major surface of the substrate.

26. The method of claim 22, wherein said plurality of box-shaped structures are metal.

27. The method of claim 22, wherein each one of said plurality of box-shaped structures comprises a plastic body covered by a layer of conductive material.

28. The method of claim 22, further comprising the step of covering the second plurality of waveguides with a conductive material, wherein the second plurality of waveguides is terminated by a short-circuit.

29. The method of claim 20, wherein each one of said plurality of substrate to freespace transitions is solid metal.

30. The method of claim 20, wherein each one of said plurality of substrate to freespace transitions comprises a plastic body covered by a layer of conductive material.

31. The method of claim 20, wherein the parallel plate waveguides are perpendicular to said substrate.

32. The wideband antenna array of claim 21, wherein the parallel plate waveguides are perpendicular to said substrate.

33. The method of claim 20, wherein the substrate is a microwave substrate.

34. A method for making a wideband antenna array, the method comprising the steps of:

providing a substrate;

attaching a plurality of substrate to freespace transitions disposed in an array to a first major surface of said substrate, the plurality of substrate to freespace transitions defining a first plurality of waveguides therebetween; and placing a plurality of probes over said plurality of first waveguides, wherein said plurality of substrate to freespace transitions are projecting, tapering structures.

35. The method of claim 34, wherein the substrate is a microwave substrate.

36. A wideband antenna array comprising:

a plurality of subarrays, each subarray comprising:

a substrate having a plurality of probes parallel to said substrate; and wherein said plurality of probes feeds a first plurality of parallel plate waveguides and wherein at least one of said plurality of subarrays is attached to at least another subarray of said plurality of subarrays by connecting at least one of said plurality of probes of the at least one subarray to at least one of said plurality of probes of the at least another subarray.

37. The wideband antenna array of claim 36, wherein each subarray further comprises a plurality of box-shaped structures disposed in an array and attached to a second major surface of said substrate, the plurality of box-shaped structures defining a second plurality of waveguides therebetween, the second plurality of waveguides aligning with the first plurality of waveguides.

38. The array of claim 36, wherein the substrate is a microwave substrate.

39. A antenna array comprising:

a substrate having a plurality of co-planer waveguide transmission lines and a plurality of probes;

a first plurality of box-shaped structures having walls disposed in an array and attached to a first major surface of said substrate, the first plurality of box-shaped structures defining a first plurality of waveguides therebetween, at least one wall of said first plurality of box-shaped structures having a notch; and a plurality of tapered structures disposed in an array and attached to a second major surface of said substrate, the plurality of tapered structures defining a second plurality of waveguides therebetween, the second plurality of waveguides aligning with the first plurality of box-shaped structures, wherein said plurality of probes aligning with said first and second plurality of waveguides.

40. The array of claim 39, wherein the substrate is a microwave substrate.

* * * * *